United States Patent [19]

French

[11] 4,146,272

[45] Mar. 27, 1979

[54] EXPLOSIVE PLACEMENT FOR EXPLOSIVE EXPANSION TOWARD SPACED APART VOIDS

[75] Inventor: Gordon B. French, Bakersfield, Calif.

[73] Assignee: Occidental Oil Shale, Inc., Grand Junction, Colo.

[21] Appl. No.: 833,240

[22] Filed: Sep. 14, 1977

[51] Int. Cl.[2] ..... E21B 43/24; E21B 43/26

[52] U.S. Cl. ..... 299/2; 102/23; 166/259; 166/299; 299/13

[58] Field of Search ..... 166/247, 259, 299; 299/2, 13; 102/23

[56] References Cited

U.S. PATENT DOCUMENTS

| | | | |
|---|---|---|---|
| 2,609,750 | 9/1952 | McFarland | 102/23 |
| 3,001,776 | 9/1961 | Van Poollen | 299/2 |
| 3,316,020 | 4/1967 | Bergstrom | 299/2 |
| 3,434,757 | 3/1969 | Prats | 299/13 X |
| 3,537,753 | 11/1970 | Arendt | 299/13 X |
| 3,688,843 | 9/1972 | Nordyke | 166/247 |
| 3,714,895 | 2/1973 | Rawson | 166/247 |
| 4,043,597 | 8/1977 | French | 299/13 |

FOREIGN PATENT DOCUMENTS

| | | | |
|---|---|---|---|
| 1012564 | 6/1977 | Canada | 299/13 |
| 2005659 | 8/1971 | Fed. Rep. of Germany | 299/13 |

OTHER PUBLICATIONS

Lang, L. C., "The Application of Spherical Charge Technology in Stope and Pillar Mining", Engineering and Mining Journal, May, 1976, pp. 98–101.

Blakey, P. N. et al, "Kidd Creek's Innovative Blast Hole Sublevel Stoping", *Mining Engineering*, Jun., 1976, pp. 25–31.

"Facts About Delay Blasting", from Du Pont Research. E. I. Du Pont de Nemours and Co., Blasters' Handbook; (1969), 15th Edition; pp. 220, 229, 230, 246, 247, 402, and 403.

*Primary Examiner*—Stephen J. Novosad
*Assistant Examiner*—George A. Suchfield
*Attorney, Agent, or Firm*—Christie, Parker & Hale

[57] ABSTRACT

A subterranean formation containing oil shale is prepared for in situ retorting by initially excavating a pair of spaced apart voids, leaving an intervening zone of unfragmented formation between the voids. The intervening zone has substantially parallel free faces adjoining the void. A plurality of elongated blasting holes are formed in the intervening zone of unfragmented formation, the longitudinal axis of each blasting hole being substantially perpendicular to the parallel free faces of the intervening zone. At least two deck loads of explosives are placed in each blasting hole, with each load being longitudinally spaced apart from each adjacent load by stemming. The loads of explosive are then detonated in a single round of explosions with a time delay between adjacent loads for expanding formation in the intervening zones toward both voids. The fragmented mass of formation particles is then retorted to recover shale oil from the oil shale.

74 Claims, 5 Drawing Figures

EXPLOSIVE PLACEMENT FOR EXPLOSIVE EXPANSION TOWARD SPACED APART VOIDS

BACKGROUND OF THE INVENTION

This invention relates to the recovery of constituents from subterranean formations, and more particularly to an in situ method of recovery that is particularly effective for the protection of shale oil from oil shale in an in situ retort. The term "oil shale" as used in the industry is in fact a misnomer; it is neither shale nor does it contain oil. It is a formation comprising marlstone deposit containing an organic material called "kerogen" which upon heating decomposes to produce carbonaceous liquid and gaseous products. It is the formation containing kerogen that is called "oil shale" herein, and the liquid product is called "shale oil."

The recovery of liquid and gaseous products from oil shale deposits has been described in several patents, one of which is U.S. Pat. No. 3,661,423, issued May 9, 1972, to Donald E. Garrett, assigned to the assignee of this application, and incorporated herein by reference. This patent describes in situ recovery of liquid and gaseous carbonaceous materials from a subterranean formation containing oil shale by mining out a portion of the subterranean formation. Then explosive charges dispersed through a portion of the remaining formation are detonated to fragment and expand the portion of the remaining formation to form a stationary, fragmented, permeable mass of formation particles containing oil shale, referred to herein as an insitu oil shale retort. Hot retorting gases are passed through the in situ oil shale retort to convert kerogen contained in the oil shale to liquid and gaseous products.

One method of supplying hot retorting gases used for converting kerogen contained in the oil shale, as described in U.S. Pat. No. 3,661,423, includes establishment of a combustion zone in the retort and introduction of an oxygen supplying combustion zone feed into the retort on the trailing size of the combustion zone to advance the combustion zone through the fragmented mass. In the combustion zone oxygen in the gaseous feed mixture is depleted by reaction with hot carbonaceous materials to produce heat and combustion gas. By the continued introduction of the oxygen supplying feed into the combustion zone, the combustion zone is advanced through the fragmented mass. The effluent gas from the combustion zone passes through the retort on the advancing side of the combustion zone to heat the oil shale in a retorting zone to a temperature sufficient to produce kerogen decomposition, called retorting, in the oil shale to gaseous and liquid products and a residue of solid carbonaceous material. The resulting liquid and gaseous products pass to the bottom of the retort for collection.

It is desirable that the retort contain a reasonably uniformly fragmented, reasonably uniformly permeable mass of formation particles having a reasonably uniformly distributed void volume or void fraction so gases can flow uniformly through the retort and result in maximum conversion of kerogen to shale oil. A uniformly distributed void fraction in the direction perpendicular to the direction of advancement of the combustion zone is important to avoid channeling of gas flow in the retort. The creation of a mass of particles of uniform void volume distribution prevents the formation of over-sized voids or channels which hinder total recovery of shale oil and also provides a uniform pressure drop through the entire mass of particles. In preparation for the described retorting process, it is important that the formation be fragmented and displaced, rather than simply fractured, in order to create high permeability; otherwise, too much pressure differential is required to pass gas through the retort. It is important that the retort contain a substantially uniformly fragmented mass of particles so uniform conversion of kerogen to liquid and gaseous products occurs during retorting. A wide distribution of particle size can adversely affect the efficiency of retorting because small particles can be completely retorted long before completion of retorting the core of large particles.

It has been proposed that oil shale be prepared for in situ recovery by first undercutting a portion of the formation to remove from about 5% to about 25% of the total volume of the in situ retort being formed. The overlying formation is then expanded by detonating explosives placed in the formation to fill the void created by the undercut.

The general art of blasting rock formations is discussed in *The Blaster's Handbook*, 15th Edition, published by E.I. DuPont de Nemours & Company, Wilmington, Del.

One method of explosive expansion is the so-called "V-cut" method, described at pp. 246–7 of *The Blasters' Handbook*, in which explosive charges are arranged within the formation and detonated in sequence so the formation is expanded in concentric sequential steps moving radially outwardly and upwardly within the formation generating a conical free face which propagates upwardly through the formation in accordance with the time delays between the explosive charges. A free face is the exposed surface of a mass of rock such as a surface in the vicinity of a shothole at which rock is free to move under the force of an explosion. A purpose of the V-cut method of expansion is to produce particles of relatively small size; but it has the disadvantage of tending to create a radially nonuniform void volume distribution throughout the expanded mass.

Rather than using the V-cut method of expansion, it has been proposed to use a plurality of concentrated charges uniformly distributed throughout the formation to be expanded to produce a uniformly fragmented mass of formation particles. U.S. Pat. No. 3,434,757 issued to Prats teaches sequential detonation of a series of explosive in oil shale to form a permeable zone in the oil shale. However, it is both time consuming and expensive to place a large number of explosive charges throughout the formation.

Another method for preparing formations for in situ recovery is described in U.S. Pat. No. 4,043,597, assigned to the assignee of this invention, and incorporated herein by this reference. According to this patent, two voids vertically spaced apart from each other are excavated in the subterranean formation. This leaves a zone of unfragmented formation between the voids. Vertical blasting holes are formed in the intervening zone. Explosive is placed in the blasting holes and detonated to expand formation in the intervening zone toward both voids.

BRIEF SUMMARY OF THE INVENTION

Thus, there is provided in practice of this invention in one embodiment a method for fragmenting a subterranean formation by first excavating an upper void and a lower void vertically spaced apart from each other in the subterranean formation, thereby leaving an intervening zone of unfragmented formation between the voids. The zone of unfragmented formation has an upper substantially horizontal free face adjacent the upper void and a lower substantially horizontal free face adjacent the lower void. Explosive is placed in an upper zone of the unfragmented formation between the upper and lower voids. Explosive is also placed in a lower zone of the unfragmented formation between the upper and lower voids, where the lower zone is below the upper zone. The explosives placed in the upper and lower zones are detonated in a single round with a time delay between detonation of explosive in the upper zone and detonation of explosive in the lower zone for explosively expanding formation between the upper and lower voids toward both the upper and lower voids.

The explosive can be placed in the formation by forming a plurality of substantially vertical blasting holes in the intervening zone of unfragmented formation and placing at least two deck loads of explosive in such a blasting hole. The loads in such blasting hole are vertically spaced apart from each adjacent load by a mass of stemming. The loads of explosive are detonated in a single round of explosions with a time delay between adjacent loads to expand formation in the intervening zone toward both voids.

In one version of this invention, the loads are detonated sequentially toward the vertical center of mass of the intervening zone for expanding the formation uniformly toward both free faces. This is effected by detonating each such load in a blasting hole no later than detonation of any of the loads in the same blasting hole between such load and the vertical center of mass of the portion of the formation being fragmented. Sequential detonation allows creation of a new, substantially horizontally extending free face by detonation of loads, thereby providing a new free face for explosive expansion of formation in the intervening zone by subsequent detonation of loads.

In another version of this invention, each load is detonated no earlier than detonation of any of the loads between such load and one of the free faces of the formation being fragmented. This expands formation preferentially toward that free face.

Preferably the time between detonation of each load and an adjacent load in the same blasting hole is more than the time required for creation of a free face by explosive expansion of formation by detonation of the first of the adjacent loads to be detonated.

Also, preferably the time between detonation of the first load to be detonated and the last load to be detonated is less than the time required for expanding formation beyond a selected void fraction by detonation of the first load to be detonated. This permits formation of a retort containing a reasonably uniformly permeable mass of particles.

To avoid excessive seismic effect from detonation of the loads of explosive, preferably the time between detonation of loads detonated successively is sufficient for the seismic wave produced by detonation of the first load to be detonated to pass the second load to be detonated.

DRAWING

These and other aspects of the invention will be more fully understood by reference to the following detailed description and accompanying drawings in which.

DETAILED DESCRIPTION

A. General Discussion

Figure 1:
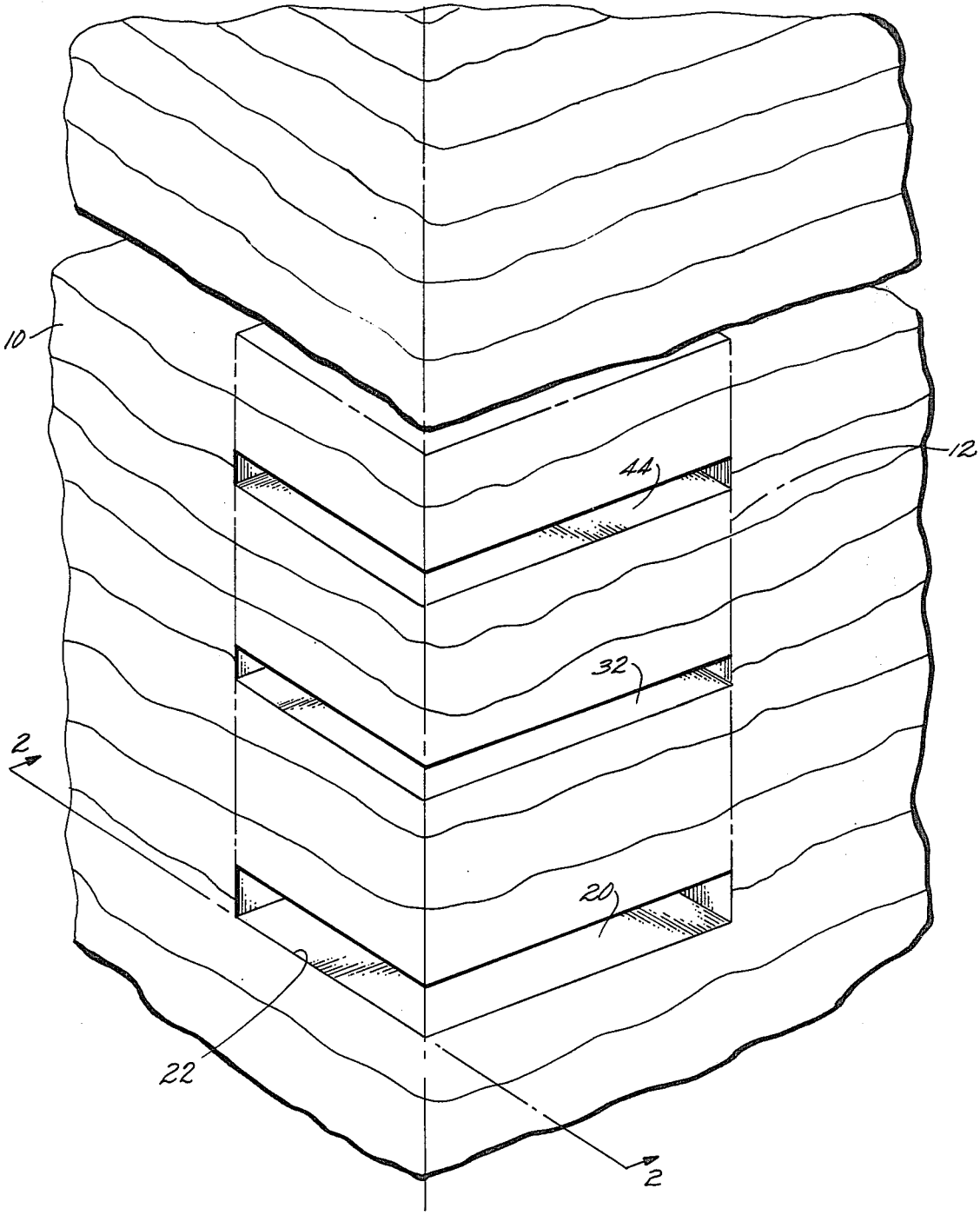
FIG. 1 is a schematic perspective view showing a subterranean formation containing oil shale in an intermediate stage of preparation for in situ recovery in accordance with principles of this invention.
Figure 2:
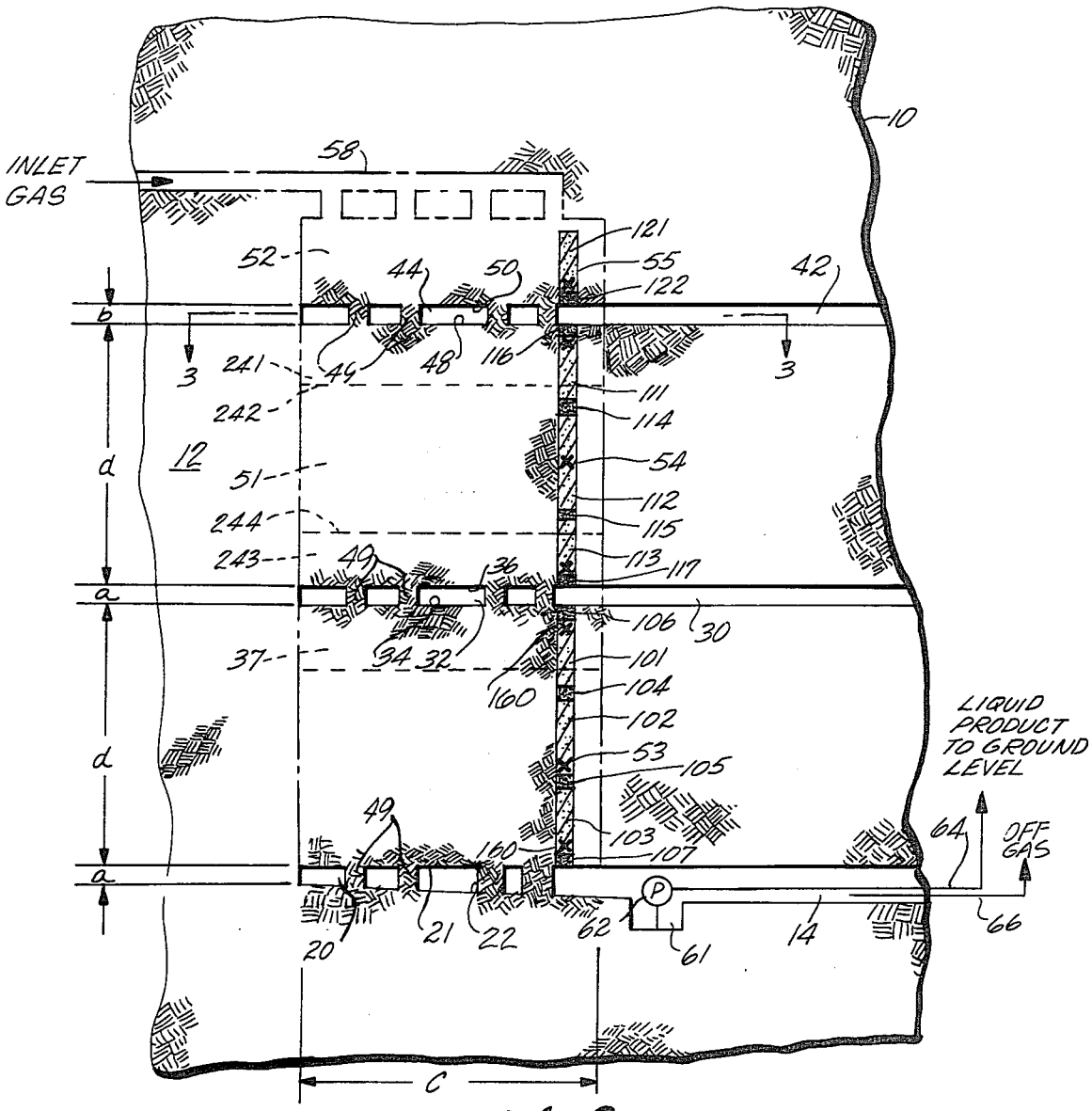
FIG. 2 is a schematic cross-sectional elevation view taken on line 2—2 of FIG. 1.
Figure 3:
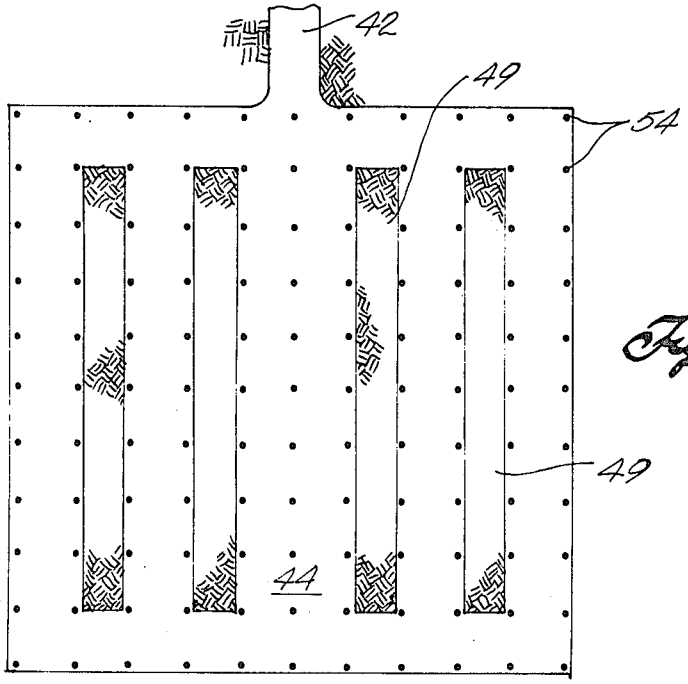
FIG. 3 is a cross-sectional plan view taken on line 3—3 of FIG. 2.

FIGS. 1-3 illustrate a subterranean formation 10, such as a subterranean formation containing oil shale, which is in an intermediate stage of preparation for in situ recovery of carbonaceous values such as shale oil and hydrocarbon gaseous products. Generally speaking, in situ recovery is carried out by initially excavating formation from a portion of the subterranean formation and then explosively expanding a remaining portion of the formation to produce a fragmented permeable mass of formation particles containing oil shale. The present invention is described in the context of a method for ultimately producing a subterranean retort comprising an approximately rectangularly prismatic retort cavity, or room 12 (illustrated in phantom lines in FIGS. 1-3) containing a reasonably uniformly fragmented, reasonably uniformly permeable mass of expanded formation particles having a reasonably uniformly distributed void fraction for economical retorting operations. In the illustrated embodiment, the in situ retort being formed is square in horizontal cross-section having a vertical dimension or height which is greater than its maximum lateral dimension or width. The height of the retort can be less than or the same as the width of the retort.

Referring to FIG. 2, access to the portion of the subterranean formation containing oil shale to be expanded is established by forming a horizontal tunnel, drift or adit 14 extending to the bottom of the volume to be expanded. From the drift 14, the formation is undercut and a volume of formation is removed to form a lower void 20 at the bottom of the subterranean retort 12 to be formed. The material excavated from the lower void is hauled away through the drift 14 for removal to the surface via a shaft or adit (not shown).

The lower void 20 can be continuous across the width of the volume to be expanded, so formation overlying the lower void is completely unsupported and defines a horizontal free face 21 of the formation immediately above the lower void. If desired one or more pillars 49 of unfragmented formation can be left in the lower void to help support overlying formation as described in greater detail hereafter. The floor plan or horizontal cross section of the lower void 20 can be generally square, although the void, and also the in situ retort to be formed, can be of other horizontal cross-section such as rectangular, without departing from the scope of the invention. The floor 22 of the lower void is inclined downwardly in the direction of the drift 14 to facilitate the flow of shale oil in the direction of the drift during subsequent retorting operations.

A horizontal access tunnel or drift 30 is excavated at an elevation above the elevation of the bottom void 20. From the horizontal access drift 30, formation is excavated from the volume to be expanded to form an intermediate void 32 at an elevation above the elevation of the lower void 20. The floor plan or horizontal cross-section of the intermediate void 32 substantially matches the horizontal cross-section and area of the lower void 20 and the in situ retort 12 to be formed. Thus, the intermediate void can be square or rectangular in shape, and preferably is substantially directly above the lower void so the outer edges of the two voids lie in common vertical planes. Pillars 49 can be left in the intermediate void to support the overlying formation. Alternatively, the intermediate void can be continuous across the width of the room 12 so that the overlying portion of the formation is completely unsupported. The formation adjacent the intermediate void defines a pair of vertically spaced apart, bottom and top horizontal free faces 34 and 36, respectively, adjoining the intermediate void 32. The two voids 20 and 32 also define a lower intervening zone 37 of unfragmented formation containing oil shale left within the boundaries of the subterranean retort 12 between the substantially parallel horizontal free faces 21 and 34.

After the intermediate void 32 is formed, or concurrently therewith, a horizontal tunnel or drift 42 is excavated at an elevation above the elevation of the intermediate void 32. Formation is removed from within the boundaries of the retort 12 being formed through the drift 42 to form an upper void 44 at an elevation above the elevation of the intermediate void 32. The floor plan or horizontal cross-section of the upper void 44 is substantially similar to the cross-section of the lower and intermediate voids of the retort 12. The upper void preferably is aligned with the voids below it so that the outer edges of the upper void lie in common vertical planes with the outer edges of the voids below. The upper void 44 is approximately the same height as the intermediate void 32 and can be continuous across the width of retort 12. Thus, the portion of the formation above it can be completely unsupported. If desired one or more pillars 49 of unfragmented formation can be left in the upper void to help support the overlying formation as shown in FIGS. 2 and 3 (not shown in FIG. 1). When pillars are used in any of the voids, preferably they are at least as wide as they are high to maximize the stability of the overlying formaton. The proportion of formation extracted from the void and proportion temporarily left in the form of pillars of unfragmented formation depends on many factors such as rock properties, depth of overburden, height of the void, time the void must remain open and the like. The size and location of pillars is readily determined by conventional techniques by one skilled in mining.

The upper void defines a pair of vertically spaced apart bottom and top horizontal free faces 48 and 50, respectively, of the unfragmented formation adjoining the void. The two voids 32 and 44 also define a zone 51 of unfragmented formation left between the free faces 36 and 48. An intact zone 52 of unfragmented formation within the boundaries of the retort being formed is also left above the uppermost free face 50.

The technique for expanding oil shale illustrated in the drawings has one intermediate void between the upper void and the lower void. In other techniques according to this invention, there can be no intervening void, or there can be two or more intermediate voids one above another. The total number of voids used depends upon the height of the formation to be expanded. The greater the height of the formation to be expanded, the more voids required.

Multiple intermediate voids can be useful where the height of the retort being formed is very much larger than its width. One or two intermediate voids can be excavated between the top and bottom voids so that the in situ retort can have a substantial height without need for expanding excessively thick zones of formation between adjacent voids.

Conventional underground mining techniques and equipment are used for excavating the voids and access drifts.

After the spaced apart voids have been excavated in the formation, the intervening zones 37, 51 of unfragmented formation and the intact zone 52 above the upper void 44 are prepared for explosive expansion and subsequent retorting operations. A plurality of vertical blasting holes 53 are drilled in the lower intervening zone 37 upwardly from the lower void 20 or downwardly from the intermediate void 32. Similarly, a plurality of vertical blasting holes 54 are drilled in the upper intervening zone 51 from the intermediate void 32 or the upper void 44, and a plurality of vertical blasting holes 55 are drilled upwardly from the upper void 44 into the zone 52 of unfragmented formation above the upper void. The blasting holes 53, 54, 55 extend longitudinally through the formation and are substantially perpendicular to the free faces of the zones of unfragmented formation. One of each such vertical blasting hole 53, 54 and 55 is shown in FIG. 2. In order to show placement of explosive and stemming in these blasting holes, they are shown out of proportion in FIG. 2, i.e., the diameter of the vertical blasting holes is much smaller in relation to the dimensions of the retort 12 than shown in FIG. 2. If pillars such as the pillars 49 in the upper void 44 have been left within the voids, horizontally extending blasting holes are drilled in them for their explosive expansion.

The blasting holes are then loaded with generally cylindrical column loads of explosive and stemming. The loads of explosive are distributed in the blasting holes 53, 54 in the intervening zones 37, 51, respectively, of unfragmented formation using a variation of deck loading. Deck loading is described in *The Blasters' Handbook* at pages 220 and 229. In the method of deck loading, two or more loads of explosive are placed in a blasting hole spaced apart from each other. Each load is completely separated from an adjacent load by a mass or segment of stemming material such as sand, gravel or drill cuttings. Each load is separately primed, either electrically or with detonating cord.

Deck loading has been used to enable the explosive to be distributed according to the hardness of the rock and for distributing a charge of explosive through a blasting hole preferentially toward the bottom of the hole to provide more energy for breaking the burden near the bottom of the blasting hole than compared to the energy provided for breaking the burden nearer the free face.

According to this invention, deck loading is used to explosively expand formation toward two free faces to form a substantially uniformly fragmented, substantially uniformly permeable mass of formation particles. This is effected by detonating the deck loads of explosive in a blasting hole in a single round of explosions with a time delay between adjacent loads to stagger detonation of the loads.

With reference to FIG. 2, the blasting holes 53 in the lower intervening zone 37 of unfragmented formation each contain three cylindrical column loads, an upper or top load 101, a middle or intermediate load 102, and a lower or bottom load 103. Each load is separated from one or more adjacent loads by stemming. That is, there is a segment or mass 104 of stemming between the upper load 101 and the intermediate 102 load, and there is a segment 105 of stemming between the intermediate load 102 and the bottom load 103. A purpose of the segments of stemming between adjacent loads is to allow time delay between detonation of adjacent loads. Without the segments of stemming, detonation of one load could unavoidably lead to detonation of an adjacent load. There is also a segment 106 of stemming above the upper load 101 and a segment 107 of stemming below the lower load 103 to confine these loads to maximize efficiency of blasting.

Similarly, each blasting hole 54 in the upper intervening zone 51 contains three loads, a top load 111, a middle or intervening load 112, and a bottom load 113. Between the top and the intermediate load is a segment 114 of stemming, and between the intermediate and the bottom load is a segment 115 of stemming. A segment 116 of stemming is above the top load 111 and a segment 117 of stemming is below the bottom load 113.

Because the zone 52 of unfragmented formation above the upper void 44 is explosively expanded toward only one void, the upper void, deck loading is not required in the blasting holes 55. Thus, there is only one load 121 of explosive in each blasting hole 55. Below each load 121 there is a segment 122 of stemming. If desired, deck loading also can be used in the blasting holes 55 in the zone 52 above the upper void 44.

It should be understood that in the preferred version of this invention there are a plurality of vertical blasting holes 53, 54, 55 in the zones of 37, 51, and 52, respectively, of unfragmented formation, where each blasting hole is loaded with explosive and stemming substantially as shown in FIG. 2. The size and total number of blasting holes used is that which provides sufficient total explosive energy to expand and fragment the formation being blasted. FIG. 3 shows an arrangement which can be used for placement of the blasting holes 54 in the upper intervening zone 51 of unfragmented formation. Many variations are also useful.

Figure 4:
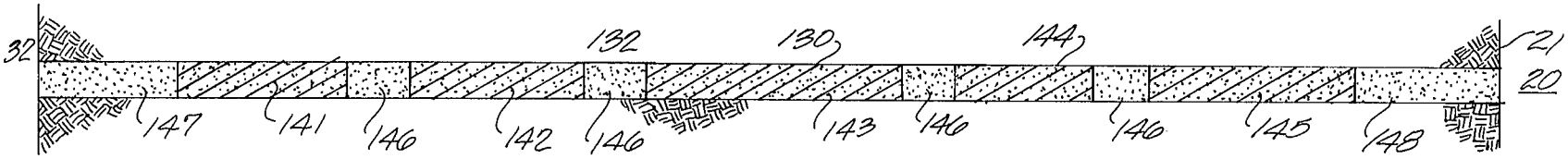
FIG. 4 shows a blasting hole extending between a pair of vertically spaced apart voids and containing explosive for expanding formation toward both voids.

In practice of this invention, there are at least two deck loads of explosive in a blasting hole in order to obtain explosive expansion of formation toward two spaced apart voids. As already discussed, blasting holes 53 and 54 each contain three loads of explosive. FIG. 4 shows a vertically extending blasting hole 130 in a zone 132 of unfragmented formation between two substantially parallel vertically spaced apart voids 20 and 32, in which the blasting hole contains five loads of explosive. The loads of explosive are numbered in FIG. 4 from top to bottom as 141, 142, 143, 144 and 145. Each load is separated from an adjacent load by a segment 146 of stemming. A segment 147 of stemming is provided above the top load 141 and a segment 148 of stemming is provided below the bottom load 145.

Sufficient stemming is provided between adjacent loads that detonation of one load does not interfere with subsequent detonation of an adjacent load and does not cause premature detonation of an adjacent load.

Use of deck loading with staggered detonation of the loads in a blasting hole can yield fragmented formation having a particle size approaching that achieved by using a plurality of independent, concentrated, spherical charges. This can be effected without incurring the cost of having a separate blasting hole for each spherical charge. For example, five individual deck loads are provided in the one blasting hole of FIG. 4. This is significantly less expensive than drilling five blasting holes for five individual charges.

Another advantage of staggering the detonation of the deck loads in a blasting hole is that more effective fragmentation is achieved compared to detonating all the loads at one time. This occurs due to a preconditioning effect, where detonation of a first charge preconditions adjacent formation by creating small cracks and fissures in the adjacent formation. Thus, when a subsequent load is detonated in the adjacent formation, the fissured formation is more readily fragmented.

Control of time delay between detonation of the deck loads in the blasting holes is important for obtaining a retort containing a uniformly fragmented mass of particles. There are three constraints on the time delay between detonation of the deck loads.

B. Constraints on Time Delay

1. Constraint I

According to the first constraint, to obtain effective fragmentation, each deck load is not detonated until the charge is sufficiently close to a free face that intervening burden is free to move due to the force of explosion of the deck load. For example, intermediate loads 102 and 112 in blasting holes 53, 54, respectively, are not detonated until the loads are adjacent a free face. For the intermediate load 102 of explosive to be adjacent a free face, it is necessary that either the upper deck load 101 or the lower deck load 103 in the blasting hole 53 be detonated to explosively expand formation toward an original free face 34 or 21, respectively, to create a new free face extending substantially parallel to the original free faces. Thus, to obtain effective expansion of fragmented formation toward two voids, the time between detonation of each intermediate load and an adjacent load between such intermediate load and a free face must be more than the time required for creation of a new free face by explosive expansion of formation by detonation of the first of the adjacent deck loads to be detonated. Only minimal expansion is needed to create the new free face; the formation is not completely expanded at the time of creation of the new free face.

Sufficient expansion is required that the primary compression resulting from detonation of a load is at least partly reflected at the adjacent free face. If there is inadequate expansion, elastic deformation of formation at the free face can bridge the gap resulting in transmission of the primary compression wave across the free face with little, if any, reflection. Reflection of the primary compression wave is important because it sets up a tension wave in the formation which contributes greatly to fragmentation of the formation.

With reference to the blasting hole 54 in the upper zone 51 of the unfragmented formation, each of the following sequences for detonation of deck loads satisfies this first constraint: 111, 112, 113; 111, 113, 112; 113, 112, 111; and 113, 111, 112. Any sequence of detonation starting with the middle load 112 violates this constraint.

Referring to FIG. 4, any sequence of detonation starting with any of the intermediate deck loads 142, 143 or 144, violates the first constraint. Exemplary of sequences which satisfy the first constraint are the following:

141, 145, 142, 144, 143
141, 142, 145, 143, 144
141, 142, 143, 145, 144
141, 142, 143, 144, 145

Exemplary of sequences which violate the first constraint are the following:

141, 145, 143, 142, 144
145, 142, 141, 144, 143
145, 141, 143, 144, 142

Expansion of formation is required to create a new free face. The time required for creation of a new free face by expansion of formation by detonation of an explosive deck load it is from about 4 to about 6 times the transit time of the primary compression wave formed from detonation of the load relative to the nearest substantially horizontal free face. As used herein, transit time refers to the round trip time of the primary compression wave from the load to the nearest free face and back to the load. Thus, according to this principle, if load 103 is detonated before load 102 in blasting hole 53, then the time between detonation of load 103 and detonation of load 102 is at least equal to from about 4 to about 6 times the round trip time of the primary compression wave from detonation of load 103 to the upper free face 21 of the lower void 20 and back to load 102. A delay of at least about 4 to about 6 transit times allows formation of a new free face by explosive expansion of formation in the zone of formation in which the load 103 is placed. The delay can be greater than 6 transit times, subject to the second constraint described below.

The primary compression wave is the highest magnitude compression wave produced by detonation of a load of explosive. It is the first wave resulting from such detonation. The transit time of the primary compression wave depends upon the distance between the load and the closest free face as well as the speed of propagation of the compression wave through the formation. The speed of the compression wave can depend on the type of formation being fragmented. For example, in a formation containing oil shale having a Fischer Assay of 30 gallons per ton, the primary compression wave from detonation of explosive travels through the formation perpendicular to the bedding plane at a velocity of from about 8,000 to 11,000 feet per second. Velocities of about 5,500 to about 7,500 feet per second are realized when detonating explosive in formation containing oil shale having a Fischer Assay of 18 gallons per ton.

2. Constraint II

The second constraint on the time of detonation of the deck loads in a zone of unfragmented formation is that the time between detonation of the first load and the last load to be detonated is less than the time required for expanding formation beyond a selected void fraction by detonation of the first load to be detonated. The purpose of this constraint is to have all the formation expanding before any portion of the formation is overexpanded beyond the selected void fraction for creation of a substantially uniform permeable mass of formation particles throughout the retort being formed.

As a specific example of this principle, if the deck loads in the blasting hole 53 are detonated in the sequence of 103, 101, 102, then the middle load 102 is detonated before formation expanded by detonation of load 103 has expanded beyond a selected void fraction. If formation is permitted to overexpand beyond the selected void fraction, it is impossible to economically reduce the void fraction of the overexpanded formation. Overexansion of a portion of the formation is undesirable because it can result in another portion of the fragmented mass of particles having a void fraction substantially below the desired void fraction. For example, if a fragmented formation is to have an average void fraction of 15% and about 80% of the formation expands to a void fraction of about 30%, then the remaining 20% of the formation has no room available for expansion.

Because there is a time delay between detonation of a load and expansion of formation adjacent that load, this time lag is considered when staggering the detonation of load in a zone of unfragmented formation. For example, if the maximum desired void fraction in a retort is about 30%, then the last load to be detonated should be detonated before formation expanding due to detonation of the first load to be detonated has expanded beyond a void fraction of about 25%. Thus, the "selected void fraction" is 25%. The purpose of the extra 5% of leeway is to accommodate the lag between the detonation of the last load to be detonated and expansion of formation due to detonation of the last load.

3. Constraint III

As the third constraint, preferably the time between detonation of deck loads in the same blasting hole is sufficient for the primary seismic wave produced by the detonation of the first load to pass the second load to be detonated. The primary seismic wave is the seismic wave of maximum amplitude produced in formation due to detonation of explosive. This delay is provided to avoid damage to structures and equipment which can occur if the primary seismic wave of two loads superimpose to yield an overly large primary siesmic wave.

The time required for the primary seismic wave from one load to pass another load depends upon the distance between the two loads, the detonation velocity of the explosive, the length of the column of explosive being detonated, and the propagation velocity of the wave through the formation. IT can be as little as one millisecond.

C. Sequence of Detonation

According to this invention all of the explosive in a zone of unfragmented formation between vertically spaced apart voids is detonated in a single round. All loads of explosive at the same elevation in a zone of unfragmented formation can be detonated simultaneously. Thus, all of the top deck loads 111 in the blasting holes 54 in the upper intervening zone 51 of unfragmented formation can be detonated simultaneously. Likewise, all of the bottom loads 113 can be detonated simultaneously and all of the intermediate loads 112 can be detonated simultaneously. Detonating a plurality of loads at the same elevation in a zone of unfragmented formation creates a new free face extending substantially parallel to the original free faces.

For example, assuming a sequence of detonation of the loads in the upper intervening zone 51 of 111, 113, 112, detonation of all of the top loads 111 in an upper portion or zone 241 of the upper intervening zone 51 expands the upper portion 241 toward the upper void 44 and creates a first new free face, shown schematic by dashed line 242 in FIG. 2, which is substantially parallel to the original free face 48 and the remaining free face 36 of the upper intervening zone 51. Likewise, detonation of the bottom loads 113 results in expansion of a lower portion 243 of the upper intervening zone toward the intermediate void 32 with creation of a second new free face shown by dashed line 244 in FIG. 2, which is substantially parallel to the first new free face 242. The first new free face 242 and the second new free face 244 are near to the top and bottom, respectively, of the middle charges 112 of explosive. Then, by detonating the remaining middle loads 112 of explosive, the remaining central portion of the upper intervening zone 51 is explosively expanded toward both the upper void 44 and the lower void 32.

To avoid excessive seismic shock and damage to above ground and below ground structure, loads of explosive at the same elevation in the formation can be sequentially detonated. Thus, all loads of explosive at the same elevation are not necessarily detonated simultaneously.

When explosively expanding formation toward two substantially parallel voids, the sequence of detonation of the deck loads in a blasting hole, the detonation point of each load, the type of explosive used for each load, and the relative amount of explosive used for the loads can all affect the proportion of formation which is expanded toward each of the voids. How each of these factors can affect the distribution of formation is now discussed.

With respect to sequence of detonation, to expand an intervening zone of unfragmented formation between an upper void and a lower void uniformly toward both voids, each load in the blasting holes is detonated no later than detonating any of the loads between such load and the vertical center of mass of the portion of the formation being fragmented.

For example, to expand the upper intervening zone 51 uniformly toward the intermediate void 32 and the upper void 44, then the middle load 112 is the last load to be detonated. Similarly, referring to FIG. 4, to uniformly distribute the intervening zone 132 of unfragmented formation toward the upper void 32 and lower void 20, the middle load 143 is the last load to be detonated, the upper intermediate charge 142 is detonated after the top load 141, and the lower intermediate load 144 is detonated after the bottom load 145.

To explosively expand formation preferentially toward one of the two parallel voids, then each deck load in a blasting hole is detonated no earlier than detonating any of the deck loads between such load and the void toward which a higher proportion of the formation is to be expanded. For example, referring to FIG. 2, to preferentially expand the lower intervening zone 37 of unfragmented formation toward the lower void 20, then the loads in the blasting holes 53 are detonated from the bottom to the top, i.e., the bottom loads 103 are detonated first, followed by the middle loads 102, and finally the top load 101. Even with this sequence of detonation expansion of formation toward both voids is unavoidable.

D. Locus of Initiation

The locus of initiation of detonation of a load affects the direction of expansion of formation adjacent the load. When detonation of a cylindrical load is initiated at one of its ends, formation tends to be preferentially expanded toward the end at which detonation is initiated. This results from the time required for the detonation wave to travel through a column of explosive.

Referring to FIG. 2, explosive initiation devices, such as electric blasting caps used for detonating explosive loads are each represented by an "X" 160. For example, it can be desired to expand the upper intervening zone 51 uniformly toward the upper void 44 and the lower void 32, and to expand the lower intervening zone 37 primarily toward the lower void 20. Thus, in the blasting holes 54 in the upper intervening zone, detonation of each top load 111 is initiated substantially at its top, detonation of each bottom load 113 is initiated substantially at its bottom, and detonation of each middle load 112 is initiated substantially in the middle of its vertical height. To expand a higher proportion of the lower intervening zone 37 toward the bottom void 20, detonation of the lower loads 103 and the middle loads 102 in the blasting holes 53 is initiated substantially at thier bottom, and detonation of the top loads 101 is initiated substantially at their top. The sequence of detonation used is the bottom loads 103 first, the middle loads 102 next, and the top loads 101 last. Preferably the bottom loads 113 in the upper intervening zone 51 and the top loads 101 in the lower intervening zone 37 are detonated substantially at the same time so that formation can be substantially expanded from both the upper intervening zones 51 and the lower interveing zone 37 toward the intermediate void 32.

E. Size of Loads and Loading Ratio

The relative size of the loads and the relative loading ratio of the explosive used for deck loads affects the proportion of formation expanded toward each of two voids. Loading ratio refers to the quantity in tons (or cubic yards) of formation blasted per pound of explosive used.

Because the middle portion of a zone of unfragmented formation is not adjacent to a void, it can be more difficult to fragment and expand the middle portion of the zone toward the voids than it is to expand the upper and lower portions of that zone. To overcome this, the intermediate loads used for expanding and fragmenting the intermediate portion of the formation can be larger and/or use explosive having a higher loading ratio than the top and bottom charges.

F. Pillars

If pillars of unfragmented formation are left in the voids, preferably the pillars are fragmented before detonating the explosive in the blasting holes in the intervening zones of formation so the pillars do not interfere with explosive expansion of the intervening zones of formation. Thus, preferably explosive in the upper intervening zone 51 is not detonated until after creation of the free face at the juncture of the pillars 59 in the upper void 42 and the upper intervening zone 51 by detonation of explosive in the pillars.

After the pillars 49 are explosively fragmented, caving of formation supported by the pillars can occur. Since such caving can interfere with explosive expansion of the upper intervening zone 51 toward the upper void 44, explosive in the upper intervening zone preferably is detonated before or at the same time as caving of the formation 52 previously supported by the pillars 49. To this same effect, explosive in the blasting holes 54 in the upper intervening zone is detonated before or at the same time as explosive is detonated in the blasting holes 55 in the zone 52 of unfragmented formation above the upper void 44.

To obtain a uniform distribution of formation in a void containing pillars, preferably explosive in an unfragmented zone below and/or above the void is not detonated until after pillar fragments from fragmenting the pillars in the voids are uniformly distributed. Thus, preferably the loads of explosive in the upper intervening zone 51 and the loads 55 of explosive in the zone 52 above the upper void are not detonated until after pillar fragments resulting from fragmenting the pillars 53 in the upper void are substantially uniformly distributed in the upper void 44. In this regard it can be noted that caving of formation previously supported by pillars is time dependent, the start of caving depends on the properties of the formation, its depth and the unsupported span. In some cases many seconds can elapse between removal of pillars and caving of overlying formation.

G. Void Fraction

The distributed void fraction or volume of the permeable mass of particles in the retort, i.e., the ratio of the volume of the voids or spaces between particles to the total volume of the fragmented permeable mass of particles in the subterranean in situ retort 12, is controlled by the volume of the excavated voids into which the formation is expanded. Preferably, the total volume of the excavated voids is sufficiently small compared to the total volume of the retort that the expanded formation is capable of filling the voids and the space occupied by the expanded formation prior to expansion. In other words, the volume of the voids is sufficiently small that the retort is full of expanded formation. In filling the voids and the space occupied by the zones of unfragmented formation prior to fragmentation, the particles of the expanded formation become jammed and wedged together tightly so they do not shift or move after fragmentation has been completed. In numerical terms, the total volume of the voids is preferably less than about 30% of the total volume of the retort being formed. In one embodiment of this invention, the volume of the voids is preferably not greater than about 25% of the volume of the retort being formed, as this is found to provide a void fraction in the fragmented formation containing oil shale adequate for satisfactory retorting operation. If the void fraction is more than about 25%, an undue amount of excavation occurs without concomitant improvement is permeability. Removal of the material from the voids is costly, and kerogen contained therein is wasted or retorted by costly above ground methods.

The total volume of the excavated voids is also sufficiently large compared to the total volume of the retort that substantially all of the expanded formation within the retort is capable of moving enough during explosive expansion to fragment and for the fragments to be displaced and/or reoriented. Such movement provides permeability in the fragmented mass to permit flow of gas without excessive pressure requirements for moving the gas. When the fragmented particles containing oil shale are retorted, they increase in size. Part of this size increase is temporary and results from thermal expansion, and part is permanent and is brought about during the retorting of kerogen in the shale. The void fraction of the fragmented permeable mass of shale particles should also be large enough for efficient in situ retorting as this size increase occurs. In numerical terms, the minimum volume of the voids in view of the above considerations is preferably above about 10% of the total volume of the retort. Below this average percentage value, an undesirable amount of power is required to drive the gas blowers causing retorting gas to flow through the retort.

The above percentage values assume that all of the formation within the boundaries of the retort is to be fragmented; that is, there are no unfragmented regions left in the retort. If there are unfragmented regions left within the outer boundaries of the retort, e.g., for support pillars or the like, the percentages would be less.

H. Examples

In one example of practice of this invention, the total height of the in situ retort or room 12 is about 268 feet. The intermediate void 32 and lower void 20 each have a height (represented by the dimension a in FIG. 2) of about 30 feet, and the height (represented by the dimension b) of the upper void is about 23 feet. Each void contains pillars comprising about 30% of the volume of the void. Each intervening zone of unfragmented formation 37 and 51 and the zone of unfragmented formation 52 above the top void is about 184 feet square (represented by dimension c in FIG. 2) in horizontal cross-section, which essentially matches the horizontal cross-section of the voids 20, 32 and 44, although these can be a foot or so wider to accommodate drilling equipment near the edges. The thickness (represented by the dimension d) of each intervening zone is about 76 feet and the thickness of the upper zone 52 above the upper void is about 33 feet.

Explosive is dispersed in a plurality of vertical blasting holes in the upper and lower interveing zones of unfragmented formation and in the zone of unfragmented formation above the top void substantially as shown in FIG. 2. Means for detonating the loads of explosive are provided and are placed in the load of explosive substantially as shown in FIG. 2. Deck load 103 is detonated first, followed by load 102 about 25 to about 50 milliseconds later. Loads 101, 111, 113 and 121 are all detonated substantially simultaneously about 25 to 50 milliseconds after detonating load 102. Load 112 is then detonated about 25 milliseconds later.

This results in formation of a retort about 184 feet square having a height of about 268 feet filled with a reasonably uniformly fragmented, reasonably uniformly permeable mass of particles having an average void fraction of about 21.7%. As described above, this void fraction is within the desired range for maximizing recovery of shale oil from the volume being retorted and for providing for a minimal pressure drop from top to bottom of the vertical retort.

In another example, two vertically spaced apart voids are excavated in a formation containing oil shale with the lower void having a height of about 30 feet and being about 184 feet square in cross-section. The upper void has the same cross section and is about 15 feet in height. An intervening zone of unfragmented formation about 96 feet thick is left between the lower void and the upper void. Four elongated pillars, each 16 feet by 172 feet in horizontal cross-section, are left in the upper and lower voids in the pattern shown in FIG. 3. Vertical blasting holes 10 inches in diameter on 20 × 20 feet centers are drilled downwardly into the intervening zone and each is loaded with three deck loads of explosive. The upper and lower loads are 13.5 feet in height and comprise an explosive having a loading ratio of 0.55 cubic yards of formation per pound of explosive. The middle loads are 40 feet in height and comprise an explosive having a loading ratio of 0.37 cubic yards of formation per pound of explosive. Between each upper load and each middle load and between each middle load and each lower load are 4 feet of sand stemming. Below each bottom load and above each upper load are 10.5 feet of stemming. Electrical detonators are provided for each load at about its vertical center of mass. After detonation of explosive in the pillars, the upper loads are detonated, and then 25 to 50 milliseconds later the bottom loads are detonated. Then the middle loads are detonated from about 75 to about 100 milliseconds after detonation of the upper loads, i.e. about 25 milliseconds after detonation of the bottom loads. This results in a subterranean room or cavity about 141 feet high and about 184 feet square in a horizontal cross section. The room contains a substantially uniformly fragmented, substantially uniformly permeable mass of formation particles. The mass has an average void volume or void fraction of about 21.5%.

Following explosive expansion of the formation, at least one gas access communicating with an upper level of the retort 12 is established by forming a horizontal tunnel 58 and several communicating vertical conduits 60 to the top of the fragmented permeable mass of expanded formation contained in the room.

I. Recovery of Product

The recovery of shale oil and gaseous products from the oil shale in the retort generally involves the movement of a retorting zone through the fragmented permeable mass of formation particles in the retort. The retorting zone can be established on the advancing side of a combustion zone in the retort or it can be established by passing heated gas through the retort. It is generally preferred to advance the retorting zone from the top to the bottom of a vertically oriented retort, i.e., a retort having vertical side boundaries. With this orientation, the shale oil and product gases produced in the retorting zone move downwardly toward the base of the retort for collection and recovery aided by the force of gravity and gases introduced at an upper elevation.

A combustion zone can be established at or near the upper boundary of a retort by any of a number of methods. Reference is made to application Ser. No. 772,760, filed Feb. 28, 1977, now abandoned, and assigned to the assignee of the present application, and incorporated herein by this reference for one method in which an access conduit 58 is provided to the upper boundary of the retort and a combustible gaseous mixture is introduced therethrough and ignited in the retort. Off gas is withdrawn through an access means such as the drift 14 extending to the lower boundary of the retort, thereby bringing about a movement of gases from top to bottom of the retort through the fragmented permeable mass of formation particles containing oil shale. A combustible gaseous mixture of a fuel, such as propane, butane, natural gas, or retort off gas, and air is introduced through the access conduit 58 to the upper boundary and is ignited to initiate a combustion zone at or near the upper boundary of the retort. Combustible gaseous mixtures of oxygen and other fuels are also suitable. The supply of combustible gaseous mixture to the combustion zone is maintained for a period sufficient for the oil shale at the upper boundary of the retort to become heated, usually to a temperature of greater than about 900° F., so combustion can be sustained by the introduction of air without fuel gas into the combustion zone. Such a period can be from about one day to about a week in duration.

The combustion zone is sustained and advanced through the retort toward the lower boundary by introducing an oxygen containing retort inlet mixture through the access conduit 58 to the upper boundary of the retort, and withdrawing gas from below the retorting zone. The inlet mixture, which can be a mixture of air and a diluent such as retort off gas or water vapor, can have an oxygen content of about 10% to 20% of its volume. The retort inlet mixture is introduced to the retort at a rate of about 0.5 to 2 standard cubic feet of gas per minute per square foot of cross-sectional area of the retort.

The introduction of gas at the top and the withdrawal of off gases from the retort at a lower elevation serves to maintain a downward pressure differential of gas to carry hot combustion product gases and non-oxidized inlet gases (such as nitrogen, for example) from the combustion zone downwardly through the retort. This flow of hot gas establishes a retorting zone on the advancing side of the combustion zone wherein particulate fragmented formation containing oil shale is heated. In the retorting zone, kerogen in the oil shale is retorted to liquid and gaseous products. The liquid products, including shale oil, move by gravity toward the base of the retort where they are collected in a sump 61 and pumped to the surface by a pump 62 through a liquid product transfer line 64. The gaseous products from the retorting zone mix with the gases moving downwardly through the in situ retort and are removed as retort off gas from a level below the retorting zone. The retort off gas is the gas removed from such lower level of the retort and transferred to the surface via a gas product transfer line 66. The off gas includes retort inlet mixture which does not take part in the combustion process, combustion gas generated in the combustion zone, product gas generated in the retorting zone, and carbon dioxide from decomposition of carbonates contained in the formation.

J. Orientation

Many formations containing oil shale have bedding plane dips of less than about 5°, in which case the edges of the vertically spaced apart voids should be in a substantially vertical plane and the resulting retort has substantially vertical side boundaries. If the dip of the formation containing oil shale is more than about 5°, the voids can have their edges offset and be tilted so that the free faces of the intervening zone of unfragmented formation are substantially parallel to the bedding plane of the formation. The result would be a retort that is reoriented accordingly to conform to the bedding plane so that the side boundaries of the retort are perpendicular to the bedding plane. This provides oil shale having approximately the same kerogen content across the retorting zone at any particular time as the retorting zone advances through the retort. Also, expanding formation perpendicular to the bedding plane maximizes fragmentation of the formation.

The above described use of the invention for recovering carbonaceous values including shale oil from subterranean formation containing oil shale is for illustraftive purposes only, and is not considered to be a limitation of the scope of the invention. For example, the invention can be used in a variety of instances where it is desirable to prepare subterranean ore formation for in situ recovery where the particle size and subsequent void volume distribution of the ore particles are to be controlled to maximize the recovery of constituents from the formation.

In addition, instead of loading upper and lower explosive loads into the same blasting hole, a blasting hole can contain an upper explosive load and another blasting hole can contain a lower explosive load, where the center of mass of the upper explosive load is at a higher elevation than the center of mass of the lower explosive load.

Figure 5:
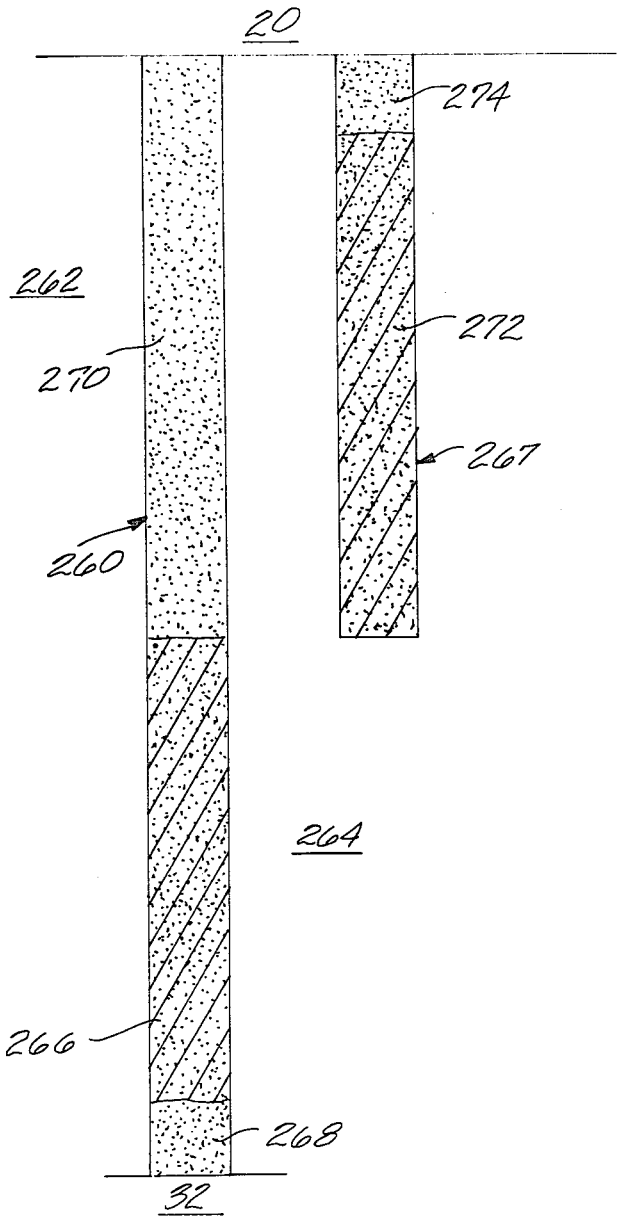
FIG. 5 shows a pair of blasting holes selectively arranged between a pair of spaced apart voids and containing explosive for expanding formation toward both voids.

For example, with reference to FIG. 5, there is shown a first blasting hole 260 extending vertically through both an upper zone 262 and a lower zone 264 of an intervening zone of unfragmented formation between an upper void 20 and a lower void 32. There is a second blasting hole 267 which is adjacent to the first blasting hole 260 and which extends vertically from the upper void 20 through the upper zone 262 of unfragmented formation. The first blasting hole contains a lower cylindrical explosive load 266 in the lower zone 264. Below the lower explosive load is a short segment 268 of stemming, and above the lower explosive load is a longer segment 270 of stemming filling the first blasting hole up to the upper void 20. The second blasting hole is loaded with an upper cylindrical explosive load 272 in the upper zone 262, and a short segment 274 of stemming above the upper load. The center of mass of the upper explosive load 272 is at a higher elevation than the center of mass of the lower explosive load 266. The upper and lower explosive loads are detonated at separate times in a single round for explosively expanding formation between the upper and lower voids toward the upper and lower voids.

A plurality of such blasting holes 260 and 267 can be used either adjacent to each other as shown in FIG. 5, or spaced apart from each other. In addition, blasting holes containing only an upper explosive load and blasting holes containing only a lower explosive load can be used in conjunction with blasting holes containing both upper and lower explosive loads.

Therefore, because of variations such as these, the spirit of scope of the appended claims should not be limited to the versions described herein.

What is clamed is:

1. A method for recovering shale oil from a subterranean formation containing oil shale, which comprises the steps of:

(a) excavating an upper void and a lower void vertically spaced apart from each other, the upper void containing at least one support pillar and being substantially directly above the lower void, thereby leaving an intervening zone of unfragmented formation between the voids having an upper free face adjacent the upper void and a lower free face adjacent the lower void;

(b) drilling a plurality of blasting holes in the unfragmented formation between the upper void and the lower void;

(c) loading each blasting hole with explosive and stemming by (i) placing a bottom load of explosive into each blasting hole, (ii) placing a first mass of stemming in each blasting hole on top of the bottom load of explosive, (iii) placing a middle load of explosive into each blasting hole, (iv) placing a second mass of stemming into each blasting hole on top of the middle load of explosive, (v) placing a top load of explosive into each blasting hole, and (vi) placing a third mass of stemming on top of the top load of explosive in each blasting hole, (d) detonating explosive in such a pillar to fragment and explosively expand such pillar;

(e) expanding formation at each free face of the zone of unfragmented formation adjacent each void toward each void to form a subtertanean room containing a stationary fragmented permeable mass of formation particles by (i) detonating the top load of explosive in each blasting hole after detonating explosive in the pillars, (ii) detonating the bottom load of explosive in each blasting hole from about 25 to about 50 milliseconds after detonating the top load of explosive, and (iii) detonating the middle load of explosive in each blasting hole from about 75 to about 100 milliseconds after detonating the top load of explosive;

(f) supplying gas to the top of the fragmented permeable mass in the room for establishing a retorting zone in the fragmented permeable mass and a downward flow of hot gas through the retorting zone; and (g) recovering shale oil produced in the retort.

2. The method of claim 1 in which the combined total volume of the voids is in the range of from about 10 to 25% of the total volume of the in situ retort being formed.

3. The method of claim 1 in which detonation of the top load of explosive in each blasting hole is initiated substantially at the top of each such load.

4. The method of claim 3 in which detonation of the bottom load of explosive in each blasting hole is initiated substantially at the bottom of each such load.

5. The method of claim 4 in which detonation of the middle load of explosive in each blasting hole is initiated substantially at the middle of the vertical height of each such load.

6. The method of claim 1 in which the bottom load and the top load have a higher loading ratio than the middle load.

7. The method of claim 6 in which the middle load contains more explosive than both the bottom load and the top load.

8. The method of claim 1 in which the middle load contains more explosive than each of the bottom and top loads.

9. A method for fragmenting a portion of subterranean formation having an upper substantially horizontal free face and a lower substantially horizontal free face spaced below the upper free face, the method comprising the steps of:

forming at least one substantially vertical blasing hole in a portion of the formation between the upper free face and the lower free face;

placing explosive in the blasting hole in at least two vertically spaced apart loads, each load being separated from an adjacent load by stemming; and explosively expanding formation toward both free faces to form a stationary fragmented permeable mass of formation particles, including particles above the elevation of the upper free face and particles below the elevation of the lower free face, by detonating the loads of explosive in a single round of explosions, wherein the time between detonation of each load and an adjacent load is more than the time required for creation of a free face by explosive expansion of formation by detonation of the first of the adjacent loads to be detonated, and wherein the time between detonation of the first load to be detonated and the last load to be deontated is less than the time required for expanding formation beyond a selected void fraction by detonation of the first load to be detonated.

10. The method of claim 9 in which each load in such a blasting hole is detonated at a different time from the other loads in such blasting hole.

11. The method of claim 10 in which the time between detonation of loads detonated successively is sufficient for the wave produced by detonation of the first load to pass the second load to be detonated.

12. The method of claim 9 in which the time between detonation of each load and an adjacent load is greater than about four times the transit time of the primary compression wave from the first of the adjacent loads to be detonated relative to the nearest substantially horizontal free face.

13. The method of claim 9 in which the time between detonation of each load and an adjacent load is greater than about six times the transit time of the primary compression wave from the first of the adjacent loads to be detonated relative to the nearest substantially horizontal free face.

14. The method of claim 9 in which one load of explosive has a different loading ratio than another load of explosive.

15. The method of claim 9 in which one load of explosive contains more explosive than another load of explosive.

16. The method of claim 9 in which each such load is detonated no earlier than detonation of any of the loads between such load and one of the free faces of the portion of the formation being fragmented.

17. The method of claim 9 wherein the selected void fraction is about 25%.

18. A method for fragmenting a subterranean formation comprising the steps of:

excavating an upper void and a lower void vertically spaced apart from each other in the subterranean formation, at least a portion of the upper void being substantially directly above the lower void, thereby leaving an intervening zone of unfragmented formation between the voids, the intervening zone having an upper free face and a lower free face;

forming a plurality of substantially vertical blasting holes in the intervening zone of unfragmented formation;

placing at least two loads of explosive in such a blasting hole with each of said loads vertically spaced apart from each adjacent load by stemming; and detonating the loads of explosive in a single round of explosions with a time delay between adjacent loads for expanding formation in the intervening zone toward both voids to form a stationary fragmented permeable mass of formation particles, including particles above the elevation of the upper free face and particles below the elevation of the lower free face.

19. The method of claim 18 in which the step of detonating comprises detonating the uppermost loads in each blasting hole before detonating the lowermost loads in each blasting hole.

20. The method of claim 18 in which the step of placing loads of explosive in such a blasting hole comprises placing at least three loads of explosive vertically spaced apart by stemming in such a blasting hole.

21. The method of claim 20 in which the step of detonating comprises sequentially detonating the loads of explosive by detonating the uppermost load of explosive in each blasting hole, then detonating the lowermost load of explosive in each blasting hole, and thereafter detonating the explosive therebetween in each blasting hole.

22. The method of claim 20 in which the step of detonating comprises sequentially detonating the loads of explosive by detonating the lowermost load of explosive in each blasting hole, then detonating the uppermost load of explosive in each blasting hole, thereafter detonating the explosive therebetween in each blasting hole.

23. The method of claim 20 in which the step of detonating comprises sequentially detonating the loads of explosive by detonating the uppermost load of explosive in each blasting hole first and detonating the lowermost load of explosive in each blasting hole last.

24. The method of claim 20 in which the step of detonating comprises sequentially detonating the loads of explosive by detonating the lowermost load of explosive in each blasting hole first and detonating the uppermost load of explosive in each blasting hole last.

25. The method of claim 18 in which at least one of the voids contains at least one pillar for supporting formation above the void and the method comprises the additional step of detonating explosive in such a pillar to fragment such pillar before detonating explosive in the blasting holes.

26. A subterranean formation in an intermediate stage of preparation for in situ recovery of constituents from the formation comprising:

(a) an upper void and a lower void located in vertically spaced apart elevations within the formation, at least a portion of the upper void being substantially directly above the lower void;

(b) a zone of unfragmented formation between the voids, the zone of unfragmented formation having an upper free face and a lower free face;

(c) a plurality of substantially vertical blasting holes in the zone of unfragmented formation, each of at least a portion of the blasting holes containing at least two loads of explosive with a segment of stemming above the uppermost load, and a segment of stemming between all adjacent loads; and (d) means for detonating the loads of explosive in a single round of explosions with a time delay between adjacent loads so that detonation of explosive will expand formation in the zone of unfragmented formation toward each void and form a subterranean cavity containing a stationary fragmented permeable mass of formation particles wherein the void fraction of the fragmented mass is controlled by the volume of the excavated voids into which the formation is expanded.

27. The subterranean formation of claim 26 in which such a blasting hole contains at least an upper load, a middle load, and a lower load of explosive.

28. The subterranean formation of claim 27 wherein each of at least a portion of the blasting holes contains an upper load of explosive, a lower load of explosive, and a middle load of explosive, wherein the means for detonating comprises means for detonating the upper load of explosive in such blasting hole, means for detonating the lower load of explosive in such blasting hole after detonating the upper load of explosive in such blasting hole, and means for detonating the middle load of explosive in such blasting hole after detonating the lower load of explosive in such blasting hole.

29. The subterranean formation of claim 28 in which the means for detonating comprises means for detonating the lower load in such blasting hole from about 25 to about 50 milliseconds after detonating the upper load in such blasting hole.

30. The subterranean formation of claim 28 in which the means for detonating comprises means for detonating the middle load in such blasting hole from about 25 to about 75 milliseconds after detonating the lower load in such blasting hole.

31. The subterranean formation of claim 28 in which the means for detonating comprises means for detonating the middle load in such blasting hole from about 75 to about 100 milliseconds after detonating the upper load in such blasting hole.

32. The subterranean formation of claim 28 in which the middle load contains more explosive than each of the lower and upper loads.

33. The subterranean formation of claim 26 in which the combined volume of the voids is in the range of from about 10% to about 25% of the total volume of the subterranean cavity produced after expansion of the formation.

34. The subterranean formation of claim 26 comprising means for initiation of detonation of each load of explosive substantially in the middle of the vertical height of such load.

35. The subterranean formation of claim 26 comprising means for initiation of detonation of the upper load of explosive in such a blasting hole substantially at the top of such load.

36. The subterranean formation of claim 26 comprising means for initiation of detonation of the lower load of explosive in such a blasting hole substantially at the bottom of such load.

37. A method of forming an in situ oil shale retort in a subterranean formation containing oil shale, the method comprising the steps of:

excavating an upper void and a lower void vertically spaced apart from each other, at least a portion of the lower void being substantially directly below the upper void, thereby leaving an intervening zone of unfragmented formation between the voids, the intervening zone having an upper free face and a lower free face;

forming a plurality of substantially vertical blasting holes in the intervening zone of unfragmented formation;

placing in each of at least a portion of said blasting holes a bottom load of explosive, a top load of explosive, and at least one intermediate load of explosives therebetween with stemming between adjacent loads of explosive; and explosively expanding formation from the intervening zone of unfragmented formation toward both voids by detonating all of the loads of explosive in each blasting hole in a single round of explosions with a time delay between adjacent loads in each blasting hole for forming a stationary fragmented permeable mass of formation particles wherein the void fraction of the fragmented mass is controlled by the volume of the excavated voids into which the formation is expanded.

38. The method of claim 37 wherein each top load and each bottom load are detonated before at least one of the intermediate loads therebetween.

39. The method of claim 38 in which at least one of the intermediate loads between such a top load and such a bottom load is detonated substantially in the middle of the vertical height of such intermediate load.

40. The method of claim 37 in which detonation of each top load is initiated substantially at the top of such load.

41. The method of claim 40 in which detonation of each bottom load is initiated substantially at the bottom of such load.

42. The method of claim 37 in which detonation of each bottom load is initiated substantially at the bottom of such load.

43. A method for forming an in situ oil shale retort in a subterranean formation containing oil shale by fragmenting a selected portion of the formation having a pair of original substantially horizontal free faces, the method comprising explosively expanding a zone of formation between the free faces toward both free faces by the steps of:

commencing explosive expansion of a first zone of formation adjacent one of said original free faces for creating a first new free face extending substantially parallel to the remaining original free face;

commencing explosive expansion of a second zone of formation adjacent the other one of said original free faces for creating a second new free face extending substantially parallel to the first new free face; and commencing explosive expansion of a third zone of formation adjacent at least one of said new free faces between the first and second zones, the time between commencing expansion of the third zone and commencing expansion of the first zone being less than the time required for completing expansion of the first zone.

44. A method of forming an in situ oil shale retort in a subterranean formation containing oil shale, said in situ retort having top, bottom and side boundaries and containing a stationary fragmented permeable mass of formation particles containing oil shale, comprising the steps of:

excavating a lower void within the boundaries of the retort being formed;

excavating an upper void within the boundaries of the retort being formed and above the lower void, and leaving unfragmented formation between the upper and lower voids, the unfragmented formation having an upper free face and a lower free face;

placing explosive in an upper zone of the unfragmented formation between the upper and lower voids;

placing explosive in a lower zone of the unfragmented formation between the upper and lower voids, the lower zone being below the upper zone; and detonating explosives in the upper and lower zones in a single round with a time delay between detonation of explosive in the upper zone and detonation of explosive in the lower zone for explosively expanding formation between the upper and lower voids toward the upper and lower voids for forming the stationary fragmented permeable mass of formation particles, the mass including particles above the elevation of the upper free face and particles below the elevation of the lower free face and having a void fraction controlled by the volume of the excavated voids into which the formation is expanded.

45. The method of claim 44 wherein explosive is placed and detonated by:

forming a plurality of vertically extending blasting holes in the upper and lower zones;

loading a lower explosive load in such a blasting hole in the lower zone;

loading an upper explosive load in such a blasting hole in the upper zone and separated from the lower explosive load by stemming; and detonating the upper and lower explosive loads at separate times in a single round.

46. The method of claim 45 in which detonation of such a lower explosive load is initiated substantially at the bottom of such load for explosively expanding formation in the lower zone primarily toward the lower void.

47. The method of claim 45 in which detonation of such an upper explosive load is initiated substantially at the top of such load for explosively expanding formation in the upper zone primarily toward the upper void.

48. The method of claim 44 wherein explosive is placed and detonated by:

forming a plurality of vertically extending blasting holes in the upper and lower zones;

loading a lower explosive load in such a blasting hole in the lower zone;

loading an upper explosive load in such a blasting hole in the upper zone, the center of mass of the upper explosive load being at a higher elevation than the center of mass of the lower explosive load; and detonating the upper and lower explosive loads at separate times in a single round.

49. The method of claim 44 wherein explosive is placed and detonated by:

forming a plurality of vertically extending blasting holes in the upper zone;

forming a plurality of vertically extending blasting holes in the lower zone;

loading a lower explosive load in such a blasting hole in the lower zone;

loading an upper explosive load in such a blasting hole in the upper zone, the center of mass of the upper explosive load being at a higher elevation than the center of mass of the lower explosive load; and detonating the upper and lower explosive loads at separate times in a single round.

50. The method of claim 49 wherein such a blasting hole in the lower zone containing a lower explosive load is formed adjacent to such a blasting hole in the upper zone containing an upper explosive load.

51. The method of claim 50 wherein such a blasting hole in the lower zone adjacent to a blasting hole in the upper zone is formed to have an upper portion extending into the upper zone.

52. The method of claim 51 including the step of loading stemming in the upper portion of such blasting hole in the lower zone adjacent to a blasting hole in the upper zone.

53. A method of forming an in situ oil shale retort in a subterranean formation containing oil shale, said in situ retort having top, bottom and side boundaries and containing a stationary fragmented permeable mass of formation particles containing oil shale, comprising the steps of:

excavating a lower void within the boundaries of the retort being formed;

excavating an upper void within the boundaries of the retort being formed and above the lower void, and leaving unfragmented formation between the upper and lower voids, such unfragmented formation having an upper zone and a lower zone and an upper free face and a lower free face, the lower zone being below the upper zone;

forming a first set of vertically extending blasting holes, where the blasting holes of the first set extend only in the upper zone;

forming a second set of vertically extending blasting holes, where the blasting holes of the second set extend in both the upper and lower zones, and such a blasting hole of the second set is adjacent a blasting hole of the first set;

loading an upper explosive load in such a blasting hole of the first set adjacent a blasting hole of the second set and loading a lower explosive load in such adjacent blasting hole of the second set, where the center of mass of the upper explosive load is at a higher elevation than the center of mass of the lower explosive load;

loading stemming in such adjacent blasting holes of the second set above the lower explosive load; and detonating the upper and lower explosive loads at separate times in a single round for explosively expanding formation between the upper and lower voids toward the upper and lower voids for forming the stationary fragmented mass, the mass including particles above the elevation of the upper free face and particles below the elevation of the lower free face.

54. A subterranean formation containing oil shale in an intermediate state of preparation for forming an in situ oil shale retort containing a fragmented permeable mass of formation particles comprising:

(a) at least one upper void and a lower void located at vertically spaced apart elevations within the formation, at least a portion of the upper void being substantially directly above the lower void;

(b) a zone of unfragmented formation between the voids, the zone of unfragmented formation having an upper free face and a lower free face;

(c) explosive in an upper zone of the unfragmented formation between the upper and lower voids;

(d) explosive in a lower zone of the unfragmented formation between the upper and lower voids, the lower zone being below the upper zone; and (e) means for detonating explosives in the upper and lower zones in a single round with a time delay between detonation of explosive in the upper zone and detonation of explosive in the lower zone for explosively expanding formation between the upper and lower voids toward the upper and lower voids for forming a stationary fragmented permeable mass of formation particles in the in situ retort including particles above the elevation of the upper free face and particles below the elevation of the lower free face, the volume of the excavated voids being sufficiently small compared to the volume of the retort that the expanded formation is capable of filling the voids and the space occupied by the expanded formation prior to expansion.

55. The subterranean formation of claim 54 including a plurality of vertically extending blasting holes in the upper and lower zones, where there is a lower explosive load in such a blasting hole in the lower zone and an upper explosive load in such a blasting hole in the upper zone, the center of mass of the upper explosive load being at a higher elevation than the center of mass of the lower explosive load, wherein the detonating means comprises means for detonating the upper and lower explosive loads at separate times in a single round.

56. The subterranean formation of claim 54 including a plurality of vertically extending blasting holes in the upper zone and a plurality of vertically extending blasting holes in the lower zone, where there is a lower explosive load in such a blasting hole in the lower zone and an upper explosive load in such a blasting hole in the upper zone, the center of mass of the upper explosive load being at a higher elevation than the center of mass of the lower explosive load, wherein the detonating means comprises means for detonating the upper and lower explosive loads at separate times in a single round.

57. The subterranean formation of claim 56 wherein such a blasting hole in the lower zone containing a lower explosive load is adjacent to such a blasting hole in the upper zone containing an upper explosive load.

58. The subterranean formation of claim 57 wherein such a blasting hole in the lower zone adjacent to a blasting hole in the upper zone has an upper portion extending into the upper zone.

59. The subterranean formation of claim 57 including stemming in the upper portion of such blasting hole in the lower zone adjacent to a blasting hole in the upper zone.

60. A method for forming an in situ oil shale retort in a subterranean formation containing oil shale comprising the steps of:

excavating within the formation of a pair of spaced apart voids and leaving an intervening zone of unfragmented formation between the voids, the intervening zone having substantially parallel free faces adjoining the voids;

forming a plurality of elongated blasting holes in the intervening zone of unfragmented formation, the longitudinal axis of each blasting hole being substantially perpendicular to the parallel free faces of the intervening zone;

placing at least two cylindrical loads of explosive in such a blasting hole with the loads longitudinally spaced apart from each adjacent load by stemming; and detonating the loads of explosive in a single round of explosions with a time delay between adjacent loads in such a blasting hole for expanding formation in the intervening zone toward both voids, and wherein the time between detonation of the first load to be detonated and the last load to be detonated is less than the time required for expanding formation beyond a selected void fraction by detonation of the first load to be detonated.

61. The method of claim 60 in which the combined total volume of the voids is in the range of from about 10 to 25% of the total volume of the in situ retort being formed.

62. The method of claim 60 in which the time between detonation of loads detonated successively is sufficient for the wave produced by detonation of the first load to pass the second load to be detonated.

63. The method of claim 60 in which the time between detonation of each load and an adjacent load is greater than about four times transit time of the primary compression wave from the first of the adjacent loads to be detonated relative to the nearest substantially horizontal free face.

64. The method of claim 60 in which the time between detonation of each load and an adjacent load is greater than about six times the transit time of the primary compression wave from the first of the adjacent loads to be detonated relative to the nearest substantially horizontal free face.

65. The method of claim 60 wherein the selected void fraction is about 25%.

66. A method as recited in claim 60 wherein the void fraction of the fragmented mass in the retort is controlled by the volume of the excavated voids into which the formation is expanded and said selected void fraction is less than the average distributed void fraction of the fragmented mass in the retort.

67. A subterranean formation containing oil shale in an intermediate stage of preparation for forming an in situ oil shale retort containing a fragmented permeable mass of formation particles comprising:

at least a pair of spaced apart voids with an intervening zone of unfragmented formation therebetween, the intervening zone having substantially parallel free faces adjoining the voids;

a plurality of elongated blasting holes in the intervening zone of unfragmented formation, the longitudinal axis of each blasting hole being substantially perpendicular to the parallel free faces of the intervening zone;

at least two cylindrical loads of explosive in which a blasting hole with the loads longitudinally spaced apart from each adjacent load by stemming; and means for detonating the loads of explosive in a single round of explosions with a time delay between adjacent loads in such a blasting hole for expanding formation in the intervening zone toward both voids and for forming a subterranean cavity containing a stationary-fragmented permeable mass of formation particles in the retort, wherein the time delay between the detonation of the first load to be detonated and detonation of the last load to be detonated is less than the time required for expanding formation a selected void fraction by detonation of the first load to be detonated, and the volume of the excavated voids is sufficiently small compared to the volume of the retort that the expanded formation is capable of filling the voids and the space occupied by the expanded formation prior to expansion.

68. The subterranean formation of claim 67 comprising means for initiation of detonation of each load of explosive substantially in the middle of the vertical height of such load.

69. The subterranean formation of claim 67 wherein each of at least a portion of the blasting holes contains an upper load of explosive, a lower load of explosive, and a middle load of explosive, wherein the means for detonating comprises means for detonating the upper load of explosive in such blasting hole, means for detonating the lower load of explosive in such blasting hole, after detonating the upper load of explosive in such blasting hole, and means for detonating the middle load of explosive in such blasting hole after detonating the lower load of explosive in such blasting hole.

70. The subterranean formation of claim 69 in which the means for detonating comprising means for detonating the lower load in such blasting hole from about 25 to about 50 milliseconds after detonating the upper load in such blasting hole.

71. The subterranean formation of claim 70 in which the means for detonating comprises means for detonating the middle load in such blasting hole from about 25 to about 75 milliseconds after detonating the lower load in such blasting hole.

72. The subterranean formation of claim 69 in which the means for detonating comprises means for detonating the middle load in such blasting hole from about 75 to about 100 milliseconds after detonating the upper load in such blasting hole.

73. A subterranean formation as recited in claim 67 wherein the void fraction of the fragmented mass in the retort is controlled by the volume of the excavated voids into which the formation is expanded and said selected void fraction is less than the average distributed void fraction of the fragmented mass in the retort.

74. The subterranean formation of claim 67 in which the selected void fraction is about 25%.

* * * * *

UNITED STATES PATENT AND TRADEMARK OFFICE

CERTIFICATE OF CORRECTION

PATENT NO. : 4,146,272

DATED : March 27, 1979

INVENTOR(S) : Gordon B. French

It is certified that error appears in the above-identified patent and that said Letters Patent are hereby corrected as shown below:

Abstract, line 16, "zones" should be -- zone --.
Column 1, line 9, "protection" should be -- production --.
Column 5, line 48, "formaton" should be -- formation --.
Column 9, line 17, "it" should be deleted.
Column 10, line 5, "Overexansion" should be -- Overexpansion --;
Column 10, line 66, "schematic" should be -- schematically --.
Column 12, line 16, "thier" should be -- their --;
Column 12, line 26, "interveing" should be -- intervening --;
Column 12, line 54, "59" should be -- 49 --.
Column 13, line 47, "is" should be -- in --.
Column 14, line 32, "interveing" should be -- intervening --.
Column 18, line 53, "blasing" should be -- blasting --.
Column 25, line 21, "57" should be -- 58 --.

Signed and Sealed this

*Thirty-first* Day of *July 1979*

[SEAL]

*Attest:*

*Attesting Officer*

LUTRELLE F. PARKER

*Acting Commissioner of Patents and Trademarks*